US005676013A

United States Patent [19]

Kahlau

[11] Patent Number: 5,676,013

[45] Date of Patent: Oct. 14, 1997

[54] SPIRAL COMPONENT FOR A BALUSTER AND METHOD AND MACHINE FOR MAKING SAME

[76] Inventor: Bernhard K. Kahlau, 60 River Dr., Lake Hiawatha, N.J. 07034

[21] Appl. No.: 507,759

[22] Filed: Jul. 26, 1995

[51] Int. Cl.[6] ..... B21D 11/14

[52] U.S. Cl. ..... 72/299

[58] Field of Search ..... 72/299, 371, 64, 72/65, 298; 140/149, 92.2, 120

[56] References Cited

U.S. PATENT DOCUMENTS

| | | | |
|---|---|---|---|
| 111,097 | 1/1871 | Tuddenham . | |
| 783,803 | 2/1905 | Vogel | 140/149 |
| 825,511 | 7/1906 | Blondell | 72/299 |
| 1,095,324 | 5/1914 | Hall . | |
| 2,145,040 | 1/1939 | Cawthra | 153/78 |
| 2,216,758 | 10/1940 | Schmidt | 153/78 |
| 2,881,822 | 4/1959 | Henry | 153/78 |
| 3,113,760 | 12/1963 | Huret et al. | 256/59 |
| 3,182,480 | 5/1965 | Menichi | 72/299 |
| 3,750,720 | 8/1973 | Steigerwald | 72/299 |
| 4,019,356 | 4/1977 | Bohl | 72/30 |
| 4,026,137 | 5/1977 | Scroggins | 72/299 |

FOREIGN PATENT DOCUMENTS

| | | | |
|---|---|---|---|
| 2233079 | 1/1974 | Germany | 72/299 |
| 26 50 086 | 3/1978 | Germany . | |
| 196121 | 11/1983 | Japan | 72/299 |

*Primary Examiner*—Daniel C. Crane
*Attorney, Agent, or Firm*—Thomas L. Adams

[57] ABSTRACT

Discrete bars are formed into a spiral component for a baluster by disposing a plurality of the bars side by side. A rod is butt welded to one of the two ends of the plurality of bars. Then the bars are cold twisted axially a first angular amount in one direction by applying twisting torque along the bars, without twisting the rod welded to the bars. The bars are also cold twisted in the opposite direction a second angular amount less than the first angular amount, while axially compressing the bars to form a spiral. The twisting can be done with a machine having a spaced pair of holding devices mounted on a frame. These holding devices can hold therebetween a number of the bars side by side and in abutting alignment with one of the rods. At least one of the holding devices has a holder for holding and preventing twisting of one of the rods. One of the holding devices can twist the bars while the other acts as a slider mounted on a pair of rails to be driven by a linear ram. For synchronously forming groupings of discrete bars into spiral components, a common drive motor can turn at least one of said holding devices at each of the frames. Then the bars in each of the groupings can be cold twisted synchronously and axially in one direction then the other, while axially compressing the bars to form a spiral.

27 Claims, 3 Drawing Sheets

SPIRAL COMPONENT FOR A BALUSTER AND METHOD AND MACHINE FOR MAKING SAME

BACKGROUND OF THE INVENTION

1. Field of the Invention

The present invention relates to a spiral component for a baluster and methods and machines for making the same by using a combination of twisting and untwisting together with axial compression.

2. Description of Related Art

Conventional balusters and wrought iron railings employ bars having square cross-sections. In some embodiments, the individual bars can be twisted. See U.S. Pat. No. 3,113,760. See also U.S. Pat. No. 2,145,040.

Also, blacksmiths have formed balusters with a plurality of rods arranged side by side. These rods were heated and twisted to form a tight wrap. Thereafter, the bars were slowly untwisted, again with heat applied. During the untwisting, the ends of the group of rods are hammered. The combined effect of the untwisting, heat, and hammering causes the bars to unwrap and form an open spiral.

A difficulty with this latter process is the high degree of skilled required. Also, although the process can possibly be performed with one person, normally two are required: one to apply the untwisting torque and another to hammer the untwisting bars.

Also, because the end product is affected by manually applied force, individual technique greatly affects the shape of the finished product. Moreover, the hammering has a tendency to cause sharp bends that detract from what would otherwise be the flowing lines of the spiral.

U.S. Pat. No. 111,097 shows a method for twisting metal bars either singly or in groups. To twist a group of bars, the bars are placed parallel to each other and the ends of the bars are welded together. The bars can be twisted either in a heated state or a cold state, but remain touching and never form an open spiral. This reference is unconcerned with applying axial pressure to open the midsections of the bars to form an open spiral.

U.S. Pat. No. 2,216,758 shows a method for twisting bars to form reinforcements for concrete. These bars are stretched instead of compressed and are not arranged to form an open spiral.

U.S. Pat. Nos. 2,881,822 and 1,095,324 show a method of making concrete reinforcement bars that are twisted at some point in the process. These methods employ only a single bar and are unconcerned with forming an open spiral with several bars.

German reference DE-OS 2650086 shows a machine for twisting a number of bars into a spiral, basket-shaped workpiece W (FIG. 2B). One end of workpiece W is mounted in one rotatable chuck 8 and the opposite end is mounted in chuck 15. The illustrated basket shape is achieved by turning one chuck and pushing the other with a hydraulic ram. A disadvantage with a machine of this type is the need to weld extension rods to the basket after twisting. While welding the rod before twisting is advantageous, this reference does not disclose structure that permits twisting with rods welded in place. Furthermore, for production purposes this machine will only produce one spiral basket at a time. Furthermore, the illustrated structure is not well adapted to permit the sliding action demanded by the hydraulic ram. Chuck 15 is mounted high above a beam and there is a tendency for the chuck to become caught and resist the sliding force offered by the hydraulic ram. See also German Patent DE 2660113 and U.S. Pat. No. 4,019,356.

The inventor in the last three references is the factory owner of Hebo Maschinenfabrik GmbH, Gemunden, West Germany. This company manufactures an STM series of wrought iron machines. (Relevant dates associated with such machines are unknown by inventor.)

Accordingly, there is a need for an improved baluster component that can be made easily and with highly efficient apparatus to avoid the disadvantages of the prior art.

SUMMARY OF THE INVENTION

In accordance with the illustrative embodiments demonstrating features and advantages of the present invention, there is provided a method for forming from discrete bars a spiral component for a baluster. The method includes the step of disposing a plurality of the bars side by side. Another step is butt welding one end of one rod to one of the two ends of the plurality of bars. The method includes the step of cold twisting the bars axially a first angular amount in one direction by applying twisting torque along the bars, without twisting the rod welded to the bars. Another step in the method is cold twisting the bars in the opposite direction a second angular amount less than the first angular amount, while axially compressing the bars to form a spiral.

In accordance with a second aspect of the invention, a machine can handle at least one rod and can form from a plurality of discrete bars a spiral component for a baluster. The machine has a frame and a spaced pair of holding means mounted on the frame for holding therebetween a number of the bars side by side and in abutting alignment with one of the rods. At least one of the holding means has a holder for holding and preventing twisting of one of the rods. The machine also has a deformation means for deforming the bars, which includes a twisting means and a compression means. The twisting means is mounted on the frame for turning at least one of the holding means to cause relative rotation between the pair of holding means in first one, then in an opposite sense. The compression means is mounted on the frame for urging the pair of holding means together during an interval when the pair of holding means relatively rotate in the opposite sense.

According to still another aspect of the invention a machine is provided for handling a plurality of groupings of discrete bars and for forming a spiral component for a baluster. the machine has a common drive means and a plurality of frames. Each of the frames supports and includes a deformation means and a spaced pair of holding means for holding therebetween a number of the bars, side by side. The deformation means, which can deform the bars, includes a twisting means and a compression means. The twisting means is coupled to the common drive means for turning at least one of the holding means to cause relative rotation between the pair of holding means in first one, then in an opposite sense. The compression means can urge the pair of holding means together during an interval when the holding means relatively rotate in the opposite sense.

A related method according to another aspect of the invention handles a spaced plurality of groupings of discrete bars for forming a spiral component for a baluster. The method includes the step of disposing a plurality of the bars side by side for each of the groupings. Another step is cold twisting the bars in each of the groupings synchronously and axially a first angular amount in one direction by applying twisting torque along the bars. Another step in the method is cold twisting the bars synchronously in the opposite direction a second angular amount less than the first angular amount, while axially compressing the bars to form a spiral.

According to yet another aspect of the invention a machine can form from a plurality of discrete bars, a spiral component for a baluster. The machine has a frame with a pair of rails, and a spaced pair of holding means mounted on the frame for holding therebetween a number of the bars side by side. The machine also includes for deforming the bars, a deformation means, which includes a twisting means and a compression means. The twisting means is mounted on the frame for turning at least one of the holding means to cause relative rotation between the pair of holding means in first one, then in an opposite sense. The compression means is mounted on the frame for urging the pair of holding means together during an interval when the pair of holding means relatively rotate in the opposite sense. One of the holding means has a slider slidably mounted on the pair of rails and positioned to engage the compression means.

By employing machinery and methods of the foregoing type, an improved spiral component can be fabricated effectively, especially with the foregoing machine. In a preferred machine, a pair of axially spaced chucks are mounted on a frame. One chuck can be mounted in bearings to rotate axially. The other chuck can be mounted on a slider to slide longitudinally along the axis with respect to the other chuck.

In this preferred machine, the rotatable chuck is turned by a hydraulic or electrical motor. The sliding chuck can be moved axially by means of a hydraulic ram or other linear mechanism. With such a machine, a group of metal bars can be first welded together at their opposite ends before being secured in the chucks. Thereafter, the rotatable chuck can be turned a predetermined number of turns; for example, two turns. This twists the metal bars into a tightly wound group. Thereafter, the rotatable chuck can be rotated in the opposite direction. As the bars untwist (turning anywhere from ½ to 1½ turns,) axial pressure is applied to the untwisting bars by the hydraulic ram. This axial pressure can be applied throughout the untwisting, or preferably, in a later portion of the untwisting interval. This method forms the bars into an open spiral. This spiral component can be butt welded with other metal Stock to form a baluster that can be used for various purposes.

BRIEF DESCRIPTION OF THE DRAWINGS

The above brief description as well as other objects, features, and advantages of the present invention will be more fully appreciated by reference to the following, detailed description of presently preferred, illustrative embodiments in accordance with the present invention, together with the following drawings.

DETAILED DESCRIPTION OF THE PREFERRED EMBODIMENTS

Figure 1:
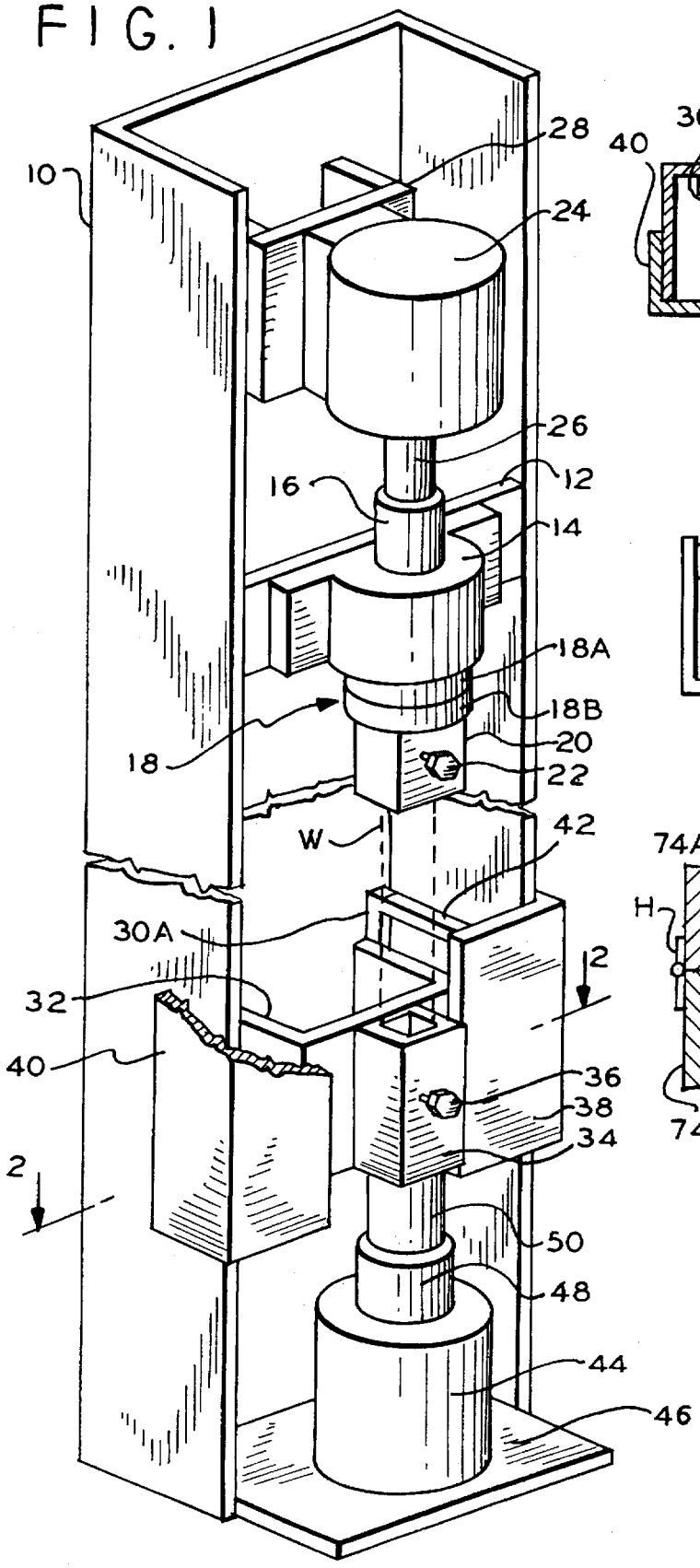
FIG. 1 is an axonometric view of a machine in accordance with the principles of the present invention.
Figure 2:
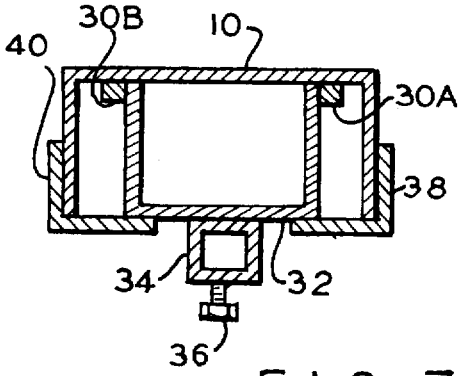
FIG. 2 is a cross sectional view, taken along line 2—2 of FIG. 1.

Referring to FIGS. 1 and 2, the illustrated machine is shown with a frame 10, in the form of a vertical steel channel. Other embodiments may use an I-beam oriented horizontally, or in other orientations (or a number of attached, parallel beams may be used). Welded between the flanges of frame 10 is a support bar 12, on which is mounted a bearing in the form of pillow block 14. A shaft 16 is rotatably mounted in bearing 14 and is connected to the inner-ring 18A of thrust-bearing 18. The outer ring 18B of thrust-bearing 18 is attached to a chuck or holder 20, also referred to as a holding means.

Chuck 20 is illustrated as a socket having four walls and a square opening. In one embodiment chuck 20 was formed from four rectangular steel plates that were welded together along their edges. One of those plates is shown with a tapped bore fitted with a setting bolt 22. Bolt 22 can be tightened on a workpiece W, shown here in phantom.

A twisting means (part of the deformation means), shown herein as hydraulic rotary motor 24, has an output shaft 26 connected to shaft 16. Motor 24 is shown mounted on a platform 28 that is attached to the web of channel 10. Instead of a hydraulic motor, some embodiments may use an electric motor or a linkage to some remote power source by means of chains, gears, belts, or other means.

Welded to the web of channel 10 are a pair of parallel rails 30A and 30B, shown herein as one inch (2.54 cm) square bars approximately 12 inches in length (30.5 cm), although other sizes are contemplated. Slider 30 is shown as a channel 32 mounted with its flanges between rails 30A and 30B. A chuck or holder 34 (also referred to as a holding means), shown in the form of a square socket is welded to the outside of the web of slider 32. Socket 34 is similar in shape to socket 20. Thus, socket 34 is formed of four metal plates that are welded into a four-sided box with a square opening matching the opening in socket 20. The outside face of socket 34 also receives the setting bolt 36 for holding workpiece W in place.

Welded to the outside of frame 10 are a pair of angle brackets 38 and 40. The inward flanges of brackets 38 and 40 point inwardly towards socket 34 and are in parallel. These flanges partially cover the front corners of slider 32. A brace 42 is shown welded between one end of rail 30A and the inside face of angle bracket 38 to brace its flange. A similar brace (not shown) is welded between angle bracket 40 and rail 30B.

A compression means (which is part of the deformation means) is shown herein as a linear ram in the form of hydraulic ram 44. Ram 44 is shown mounted atop platform 46, which is welded inside the channel of frame 10. Hydraulic ram 44 is shown with a piston rod 48 engaging a cylindrical member 50, which directly engages the chuck 34.

Accordingly, hydraulic pressure applied to ram 44 can cause slider 32 to move longitudinally between the rails 30A and 30B and within the angle brackets 38 and 40, thereby axially sliding chuck 34.

In some embodiments, slider 30 can be reconfigured as a single plate or have a different outline. In some cases slider 30 can be eliminated altogether where the side to side stability of the chuck 34, as driven by the rod 48, is adequate.

Figure 3:
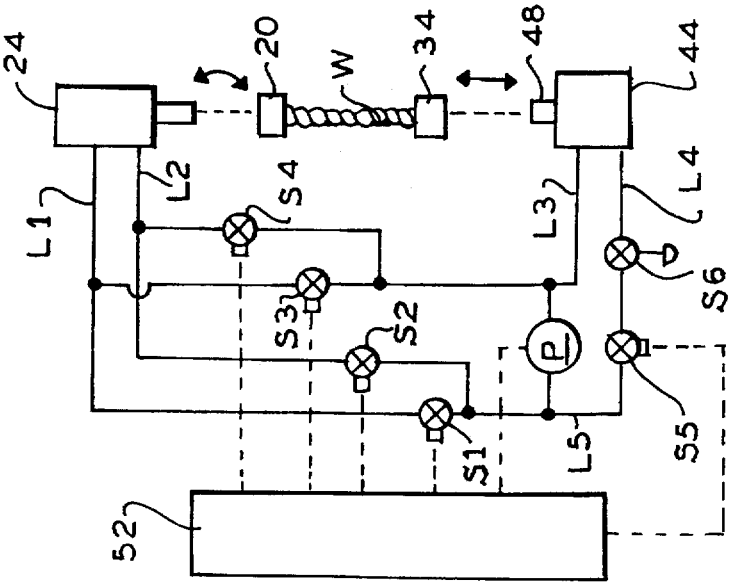
FIG. 3 is a schematic diagram of the powered units of the machine of FIG. 1, connected to a timing means and adjusting means.

Referring to FIG. 3, the previously illustrated chucks 20 and 34 are schematically shown connected to workpiece W and driven by hydraulic motor 24 and ram 44. Hydraulic motor 24 is shown connected to hydraulic lines L1 and L2, while hydraulic ram 44 is shown connected to lines L3 and L4.

A first valve means (which is part of a timing means) is shown herein as four solenoid operated hydraulic valves S1, S2, S3, and S4. Each of these valves is shown electrically controlled by controller 52, which is also part of the timing means. A second valve means (also part of the timing means) is shown as solenoid operated hydraulic valve S5, also electrically controlled by controller 52. Line L5 is shown commonly connected to one side of valves S1 and S2, whose other sides separately connect to lines L1 and L2, respectively. Line L3 commonly connects to one side of valves L3 and L4, whose other sides separately connect to lines L1 and L2.

Hydraulic pressure is established between lines L3 and L5 by hydraulic pump P, also referred to as a source of hydraulic pressure. Serially connected between lines L5 and L4 are valve S5 and manually operated valve S6, the latter being referred to as an adjusting means.

As described further hereinafter, the hydraulic power units 24 and 44 can be operated by automatically operating solenoid operating valves S1 through S5 in a sequence to be described presently. In some embodiments, controller 52 may have a five, cam-actuated switches (not shown) controlled by a stack of five cam plates (not shown) rotating on a common axis. The profiles of these cams can be staggered to cause the valves to operate in a predetermined sequence. Alternatively, controller 52 can have a microprocessor and memory (not shown) programmed to cause a timed sequence of electrical signals that are applied to solenoid operated valves S1 through S5 to operate them in a predetermined time sequence.

Other types of control systems are contemplated, including manual push buttons to allow the operator to visually examine the work in progress and determine when the sequence should be started, adjusted, and stopped. In other embodiments, motor 24 will have a mechanical counter (or series of cams) associated therewith. Thus the elapsing of revolutions can be sensed by the mechanical counter (or cam), which will then operate a switch to affect the direction and timing of rotation of motor 24, as well as the timing of ram 44.

To facilitate an understanding of the principles associated with the foregoing apparatus of FIGS. 1–3, its operation will be briefly described, with additional reference being made to the workpieces of FIGS. 4A–C and 5. The machine of FIG. 1 is initially in the condition illustrated before installation of a workpiece. At this time rod 48 is retracted fully to retract chuck 34. In some cases, shaft 50 (FIG. 1) will act as a replaceable spacer to allow a variable height adjustment for slider 32 and chuck 34.

Figure 4C:
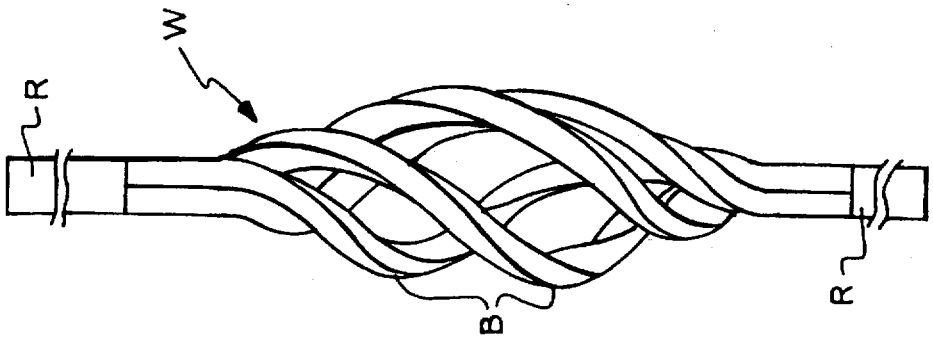
FIGS. 4A, 4B, and 4C illustrate a workpiece being processed through various stages in accordance with the principles of the present invention.
Figure 4B:
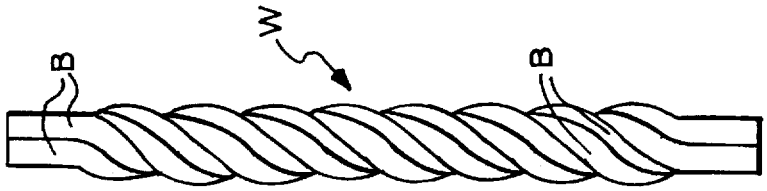
Figure 4A:
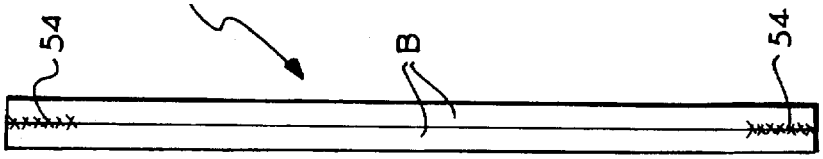
Figure 5:
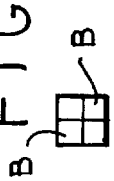
FIG. 5 is an end view of the undeformed stock of FIG. 4A.

At this time, workpiece W can be prepared as shown in FIG. 4A. In this illustrated embodiment, four identical bars B of ½ inch (1.3 cm) square stock, 12 inches (30.5 cm) long, are laid side by side. The size of these bars may be other lengths and widths, depending upon the desired size, appearance, strength, etc. The four bars B are laid together as shown in the pattern of FIG. 5. The seams between the bars B are tack welded together near the two ends as illustrated by welds 54 of FIG. 4A. For example, tack welds 54 can extend at both ends for one inch (2.54 cm) along each of the four exposed seams between bars B (that is eight seams to be welded). While tack welding bar stock together is very efficient, in some embodiments a large single square bar can be split twice along its midsection with a thin bladed saw to produce the same separate structure.

While bars B may be preferably made of steel, in other embodiments these bars may be made of iron, aluminum, or other metals. Also, while square cross-sections are preferred, in other embodiments round, polygonal, or other cross-sections can be used instead. Furthermore, the number of bars used in a group can be altered depending upon the desired complexity of the shape. Consequently, the configuration of the chuck can be altered depending upon the number of bars and manner in which they are to be stacked.

Regardless, the four illustrated square bars have an overall one inch (2.54 cm) square cross section. The tack welded assembly is then inserted first into chuck 20 (FIG. 1) and the bolt 20 is tightened to hold the workpiece W in place. Next, chuck 34 is moved onto the free end of workpiece W by sliding slider 32 along rails 30A until the workpiece is fitted into the opening of chuck 34. Then, setting bolt 36 is tightened to hold workpiece W in chuck 34.

Any space existing between rod 48 and chuck 34 can be made up by inserting an appropriate driving shaft 50, which can act partially as a shim. Alternatively, in some jacks, rod 48 can be extended by twisting the ram to extend or retract it.

Next, controller 52 of FIG. 3 is started to apply power to pump P, which then produces hydraulic pressure between lines L3 and L5, with no further effect. Next, controller 52 simultaneously opens solenoid valves S1 and S4 to apply hydraulic pressure to motor 24 causing it to rotate. Consequently shaft 26 (FIG. 1) rotates to cause chuck 20 to rotate as well. The motor 24 therefore rotates chuck 20 at a rate of about 20–40 RPM, although other speeds are contemplated, depending upon the materials, size, the torque required, etc.

As a result, workpiece W of FIG. 4A is cold twisted, in this embodiment, in the sense of a right hand thread, although twisting in the opposite sense is also contemplated. Although chuck 20 turns, chuck 34 cannot, because slider 32 is held in position between rails 30A and 30B and angle brackets 38 and 40. Ultimately, workpiece W is twisted to the extent shown in FIG. 4B. FIG. 4B represents two turns of right-handed twisting.

Next, valves S1 and S4 are closed by controller 52, while valves S2 and S3 open. Consequently, motor 24 reverses its direction of rotation, now causing workpiece W to untwist. Significantly, this untwisting is done without heat, i.e., a cold untwisting.

Either immediately, or preferably after a brief period of untwisting, valve S5 opens to apply pressure through valve S6 to hydraulic ram 44. While rod 48 will then move to take up any play between ram and the chuck 34; primarily, ram 44 applies pressure through chuck 34 along the axis of workpiece W. In one preferred embodiment one ton of force was applied axially to the workpiece W, although other forces are contemplated, depending upon the size of the stock, the strength of the material, the desired shaping, etc. In that embodiment, the application of the force by ram 44 is delayed until while the initial untwisting proceeds through three quarters of a turn.

In any event, the cold untwisting caused by motor 24 proceeds until one turn is completed. The resulting open spiral is illustrated in FIG. 4C. It will be appreciated that the openness (maximum diameter) can be adjusted by adjusting the amount of axial pressure applied by ram 44. The amount of force applied through ram 44 can be adjusted by manual valve S6.

After motor 24 has finished its untwisting, controller 52 deactivates pump P and opens all of the valves S1 through S5. This removes all pressure from motor 24 and ram 44.

The spiral component thus produced can now be butt-welded to square stock such as rods R (FIG. 4C). This butt welding can be performed by laying the rods end to end with the spiral workpiece and butt welding with a resistance welding device such as a Model 110 or 130 BWDT manufactured by Lors Machinery, Inc. of Union, N.J.. Alternatively, the rods R can be welded in place using other conventional welding techniques.

The length of rods R are chosen to suit the ultimate application for the finished workpiece. With the rods R in place, the finished workpiece can be ground, sanded, painted and installed as a baluster in a railing, gate, fence, banister, in wrought iron furniture, or for other useful purposes.

Figure 6:
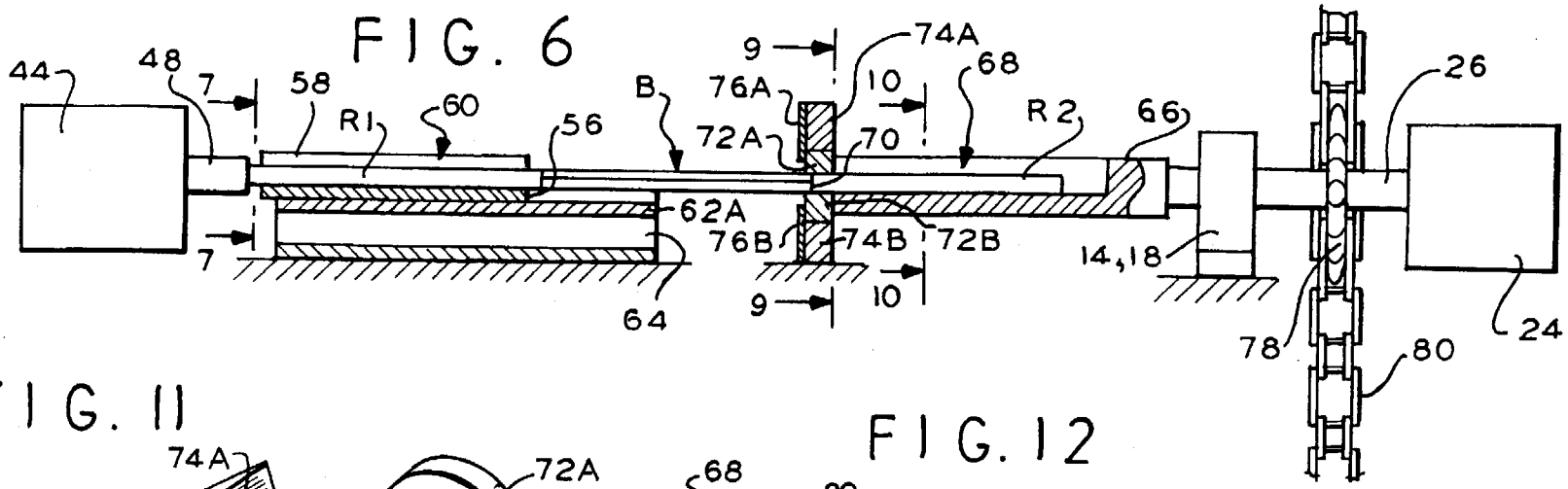
FIG. 6 is a schematic, side elevational view, partly in section, of a machine that is an alternate to that of FIG. 1.

Referring to FIG. 6, a group of four square bars B are shown butt welded to two extension rods R1 and R2. In this embodiment, the rods are butt welded before any twisting of bars B occurs. The illustrated bars B are made of ½" stock, although other dimensions can be used instead. In this embodiment, components identical to that previously illustrated bear the same reference numeral. As before, a compression means is illustrated as hydraulic linear ram 44 having a piston rod 48 engaging the distal end of left rod R1.

Figure 7:
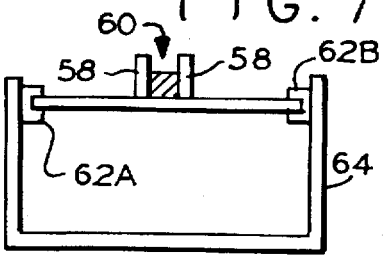
FIG. 7 is a cross-sectional view taken along line 7—7 of FIG. 6.
Figure 8:
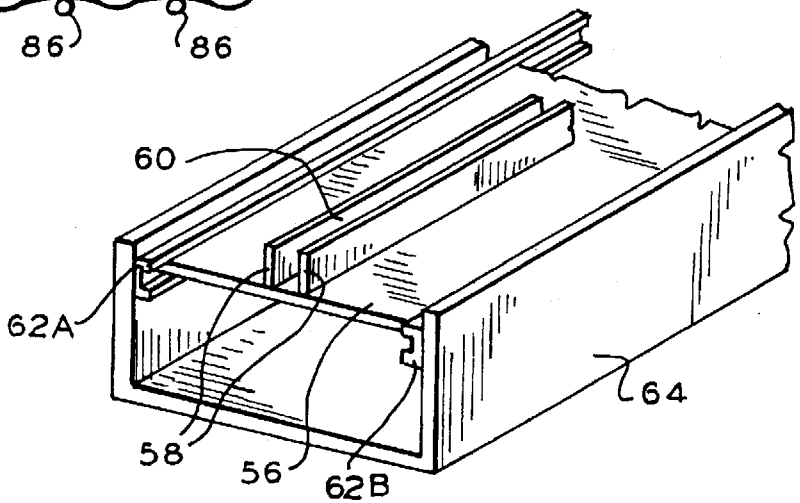
FIG. 8 is an axonometric view, with portions broken away for simplification purposes, of the sliding holding means of FIG. 6.

Referring to FIGS. 6, 7 and 8, a holding means is shown as a plate member 56 (also referred to as a slider). Welded atop member 56 are a pair of upright, parallel ribs 58 forming between them a holding channel 60. Plate member 56 is slidably mounted on rails shown herein as C-shaped channels 62A and 62B mounted on opposing faces of channel 64.

Figure 10:
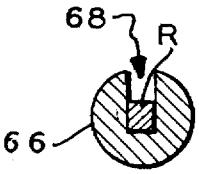
FIG. 10 is a cross-sectional view taken along line 10—10 of FIG. 6.

Previously illustrated hydraulic rotary motor 24 (also referred to as a twisting means or common drive means) has an output shaft 26 supported by a pillow block 14 and thrust bearing 18 (shown as a simple, combined schematic element in this view). Output shaft 26 is shown connecting to a holding means, namely, cylindrical holder 66. Holder 66 is essentially a cylindrical member having a rectangular holding channel 68 for receiving right rod R2. See also FIG. 10.

Figure 9:
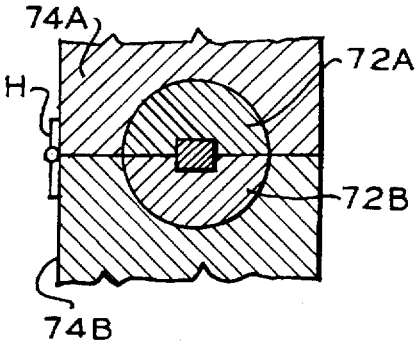
FIG. 9 is a cross-sectional view taken along line 9—9 of FIG. 6.
Figure 11:
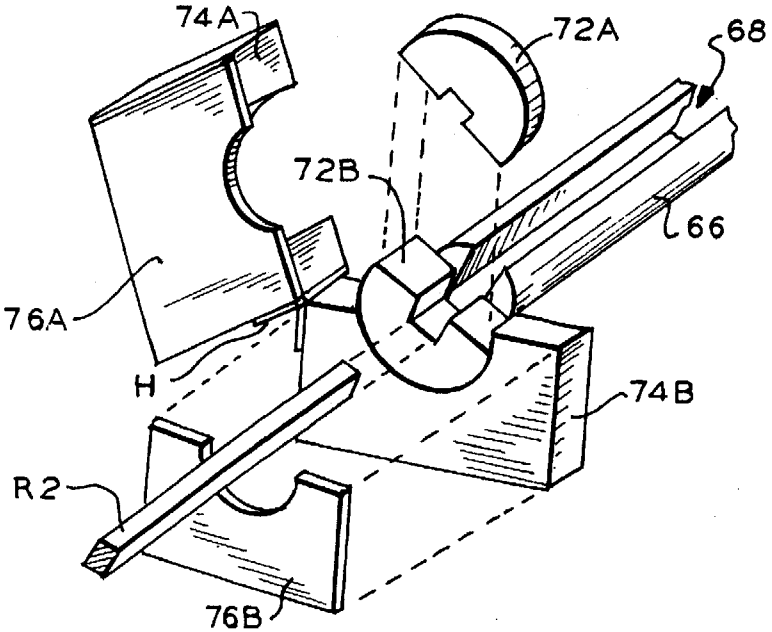
FIG. 11 is a axonometric view of the rotating holding means of FIG. 6.

Referring to FIGS. 6, 9 and 11, the right ends of bars B form a juncture 70 with right rod R2. Juncture 70 is shown mounted within split collar 72A, 72B. When assembled, split collar 72A, 72B is a generally cylindrical body with a rectangular bore designed to snugly fit about the Juncture 70 of rod R2 and bars B. Collar half 72B is shown coaxially welded to an end of holder 66 so that channel 68 is aligned with the bore in collar half 72B.

Collar 72A, 72B is rotatably mounted in split block 74A, 74B. Blocks 74A, 74B are shown connected together by hinge H. When closed, split block 74A, 74B is a rectangular block with a cylindrical bore sized to fit split collar 72A, 72B. A pair of guide plates 76A, 76B are mounted on one face of blocks 74A, 74B to provide a stop, preventing split collar 72A, 72B from moving past block 74A, 74B. Guides 76A, 76B may be metal plates that are screwed, glued, or otherwise attached to split blocks 74A, 74B.

In operation, the bar B and rods R1, R2, as shown in FIG. 6, can be butt welded as previously described. This butt welding however takes place before bars B are installed in the apparatus of FIG. 6 and before the twisting of bars B. After the butt welding, blocks 74A, 74B can be opened as shown in FIG. 11 by means of hinge H. Collar half 72A can be removed to expose channel 68 and the bore in half 72B. Accordingly, rod R2 can be placed in channel 68 with the juncture 70 (FIG. 6) mounted inside collar 72B. At this time, left rod R1 is placed in channel 60 (FIG. 8) between the ribs 58, as shown in FIG. 6. With rod R2 in place, collar half 72A may be placed over Juncture 70. Then, block 74A can be swung in place to keep the assembly together as shown in FIG. 6.

Arranged in this fashion, motor 24 can turn holder 66, thereby turning split collar 72A, 72B to twist bars B. Also, hydraulic linear ram 44 can push left rod R1 to compress bars B. This twisting and compressing can be performed in the manner previously described in connection with FIG. 3. Moreover, the bars B can be shaped as shown in FIGS. 4A, 4B and 4C, under the control of the timing means of FIG. 3.

With these operations, the rods R1 and R2 are not twisted since they are held in their respective channels 60 and 68.

In this embodiment elements 64, 74B and 14, 18 are shown secured to stationary structure, which is also herein referred to as a frame. It will be appreciated that in some embodiments the attachment point of these elements may be to distinct structures but that the frame of references stay stationary for all relevant purposes and may therefore be considered a single frame.

Figure 12:
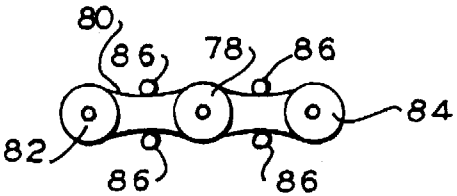
FIG. 12 is a schematic diagram of a chain and sprocket arrangement for linking machines in parallel.

Referring to FIGS. 6 and 12, shaft 26 is shown with a sprocket wheel 78 engaging a chain 80 (herein referred to as an endless drive loop). Chain 80 rides over sprocket 78. As shown schematically in FIG. 12, sprocket 78 can be a drive sprocket that causes chain 80 to rotate supplemental sprockets 82 and 84. To maintain tension on chain 80 a number of idler wheels 86 are shown riding on the chain 80 between the sprockets 78, 82 and 84. Sprockets 82 and 84 can be connected to shafts associated with structure that is essentially identical to that shown in FIG. 6, except there is no need for a rotary hydraulic motor. In this way, the workpieces associated with that structure can be rotated synchronously. Also, the hydraulic rams associated with each of these structures can be synchronized so that the workpieces are formed synchronously. While three sprockets are shown in FIG. 12, in other embodiments a greater or lesser number can be used instead.

It is to be appreciated that various modifications may be implemented with respect to the above described preferred embodiments. For example, in some embodiments one chuck may be kept stationary while the other chuck both rotates along an axis and shifts longitudinally along the same axis. In some embodiments the chuck extension can be achieved by using telescoping collars that are threaded together while either the same or differing angular rotation rates are applied to the different collars. Also, in some embodiments only one motor may be used so that a single rotary motor may rotate one chuck and then a linkage mechanism operates the other chuck to move it longitudinally towards the rotating chuck. Additionally, the overall dimensions of the operating components and workpieces can be changed depending upon the desired size, strength, durability, weight, etc. Also the various working components can be made of metal, ceramic, plastics or other materials depending upon the desired strength, structural rigidity, stability, accuracy, etc.

Obviously, many modifications and variations of the present invention are possible in light of the above teachings. It is therefore to be understood that within the scope of the appended claims, the invention may be practiced otherwise than as specifically described.

I claim:

1. A machine for handling at least one rod and for forming from a plurality of discrete bars a spiral component for a baluster, comprising:

a frame;

a spaced pair of holding means mounted on said frame for holding therebetween a number of the bars side by side and in abutting alignment with one of the rods, at least one of the holding means having a holder for holding and preventing twisting of one of the rods; and deformation means for deforming the bars, including:

(a) twisting means having a rotary motor and being mounted on said frame for turning at least one of said holding means to cause relative rotation between said pair of holding means in first one, then in an opposite sense; and (b) compression means mounted on said frame for urging said pair of holding means together during an interval when said pair of holding means relatively rotate in said opposite sense, said compression means including a linear ram coupled to a first one of said holding means, said linear ram and said rotary motor both being hydraulically powered, said rotary motor being coupled to a second one of said holding means.

2. A machine according to claim 1 wherein said holder comprises a member having a holding channel sized to cradle one of the rods along its length.

3. A machine according to claim 2 wherein said member is rotatably mounted to be driven by said twisting means.

4. A machine according to claim 2 wherein said member is reciprocatably mounted to be driven by said compression means.

5. A machine according to claim 3 comprising a slider slidably mounted in said frame and positioned to engage said compression means, said slider having a slider channel sized to cradle another one of the rods along its length and in abutting alignment with the rods.

6. A machine according to claim 1 wherein said holder comprises:

a collar sized to grip near a juncture of one of the rods and the bars.

7. A machine according to claim 6 wherein said holder comprises:

a split block for detachably and rotatably supporting said collar, said collar being split; and a member having a holding channel attached to said collar and sized to cradle one of the rods along its length, said member being rotatably mounted to be driven by said twisting means.

8. A machine according to claim 1 wherein said twisting means and said compression means are adapted to be powered by a power source, said machine comprising:

timing means coupled to said twisting means and said compression means for operating them in a predetermined sequence.

9. A machine according to claim 8 wherein said timing means is operable to sequence the compression means and the twisting means for relatively moving the pair of holding means to: (a) cold twist the bars axially a first angular amount in one direction by applying twisting torque along the bars, and (b) cold twist the bars in the opposite direction a second angular amount less than the first angular amount, while axially compressing the bars to form a spiral.

10. The machine of claim 9 wherein the first angular amount exceeds the second angular amount by about twice or more.

11. The machine of claim 10 wherein the first angular amount is about two revolutions and the second angular amount is about 0.5 to 1.5 revolutions.

12. The machine of claim 8 comprising:

adjusting means coupled to said deformation means for adjusting the balance of forces applied by said twisting means and said compression means to selectively shape said spiral component.

13. A machine for handling a plurality of groupings of discrete bars for forming a spiral component for a baluster, comprising:

a common drive means;

a plurality of frames, each of said frames supporting and including:

a spaced pair of holding means for holding therebetween a number of the bars side by side; and deformation means for deforming the bars, said deformation means including:

(a) twisting means having a wheel and being coupled to said common drive means for turning at least one of said holding means to cause relative rotation between said pair of holding means in first one, then in an opposite sense; and (b) compression means for urging said pair of holding means together during an interval when said holding means relatively rotate in said opposite sense, said common drive means including a motor, and an endless drive loop mounted to circulate over the wheel of each of the twisting means.

14. The machine of claim 13 wherein said compression means for each of said frames comprising:

a linear ram coupled to a first one of said holding means, said common drive means being rotatingly coupled to a second one of said holding means.

15. The machine of claim 13 wherein said wheel and said loop comprise a sprocket and chain, respectively.

16. The machine of claim 15 wherein said common drive means comprises:

a spaced plurality of idler wheels mounted along said chain.

17. A machine according to claim 13 comprising:

timing means coupled to said common drive means and said compression means for operating them in a predetermined sequence.

18. A machine for forming from a plurality of discrete bars a spiral component for a baluster, comprising:

a frame having a pair of rails;

a spaced pair of holding means mounted on said frame for holding therebetween a number of the bars side by side;

deformation means for deforming the bars, including:

(a) twisting means mounted on said frame for turning at least one of said holding means to cause relative rotation between said pair of holding means in first one, then in an opposite sense; and (b) compression means mounted on said frame for urging said pair of holding means together during an interval when said pair of holding means relatively rotate in said opposite sense, one of said holding means having a slider slidably mounted on said pair of rails and positioned to engage said compression means; and timing means operable to sequence the compression means and the twisting means for relatively moving the pair of holding means to: (a) cold twist the bars axially a first angular amount in one direction by applying twisting torque along the bars, and (b) cold twist the bars in the opposite direction a second angular amount less than the first angular amount, while axially compressing the bars to form a spiral.

19. The machine of claim 18 wherein the first angular amount is at least double the second angular amount.

20. The machine of claim 19 wherein the first angular amount is about two revolutions and the second angular amount is about 0.5 to 1.5 revolutions.

21. The machine of claim 18 comprising:

adjusting means coupled to said deformation means for adjusting the balance of forces applied by said twisting means and said compression means to selectively shape said spiral component.

22. The machine of claim 21 wherein said first one of said slider comprises:

a socket fixed on said slider.

23. The machine of claim 18 wherein said timing means comprises:

a source of hydraulic pressure;

a first valve means coupled between said source and said twisting means;

a second valve means coupled between said source and said compression means; and a controller coupled to said first and said second valve means for sequentially operating them.

24. A machine for handling at least one rod and for forming from a plurality of discrete bars a spiral component for a baluster, comprising:

a frame;

a spaced pair of holding means mounted on said frame for holding therebetween a number of the bars side by side and in abutting alignment with one of the rods, at least one of the holding means having a holder for holding and preventing twisting of one of the rods; and deformation means for deforming the bars, including:

(a) twisting means mounted on said frame for turning at least one of said holding means to cause relative rotation between said pair of holding means in first one, then in an opposite sense; and (b) compression means mounted on said frame for urging said pair of holding means together during an interval when said pair of holding means relatively rotate in said opposite sense, said twisting means and said compression means being adapted to be powered by a power source; and timing means coupled to said twisting means and said compression means for operating them in a predetermined sequence, said timing means being operable to sequence the compression means and the twisting means for relatively moving the pair of holding means to: (a) cold twist the bars axially a first angular amount in one direction by applying twisting torque along the bars, and (b) cold twist the bars in the opposite direction a second angular amount less than the first angular amount, while axially compressing the bars to form a spiral.

25. The machine of claim 24 wherein the first angular amount exceeds the second angular amount by about twice or more.

26. The machine of claim 25 wherein the first angular amount is about two revolutions and the second angular amount is about 0.5 to 1.5 revolutions.

27. A machine for handling at least one rod and for forming from a plurality of discrete bars a spiral component for a baluster, comprising:

a frame;

a spaced pair of holding means mounted on said frame for holding therebetween a number of the bars side by side and in abutting alignment with one of the rods, at least one of the holding means having a holder for holding and preventing twisting of one of the rods, said holder having a collar sized to grip near a juncture of one of the rods and the bars, said holder having a split block for detachably and rotatably supporting said collar, said collar being split;

deformation means for deforming the bars, including:

(a) twisting means mounted on said frame for turning at least one of said holding means to cause relative rotation between said pair of holding means in first one, then in an opposite sense; and (b) compression means mounted on said frame for urging said pair of holding means together during an interval when said pair of holding means relatively rotate in said opposite sense; and a member having a holding channel attached to said collar and sized to cradle one of the rods along its length, said member being rotatably mounted to be driven by said twisting means.

* * * * *